US011091942B1

(12) United States Patent
Diaz-Skoff

(10) Patent No.: US 11,091,942 B1
(45) Date of Patent: Aug. 17, 2021

(54) DOOR HINGE

(71) Applicant: Lucciano Diaz-Skoff, San Juan, PR (US)

(72) Inventor: Lucciano Diaz-Skoff, San Juan, PR (US)

( * ) Notice: Subject to any disclaimer, the term of this patent is extended or adjusted under 35 U.S.C. 154(b) by 0 days.

(21) Appl. No.: 16/906,322

(22) Filed: Jun. 19, 2020

(51) Int. Cl.
*E05D 5/02* (2006.01)
*E05D 11/00* (2006.01)
*E05D 5/04* (2006.01)

(52) U.S. Cl.
CPC ..... *E05D 11/00* (2013.01); *E05D 5/04* (2013.01); *E05Y 2900/132* (2013.01)

(58) Field of Classification Search
CPC ..... E05D 2007/0484; E05D 5/0276; E05D 5/0238; E05D 5/0215; E05D 5/0223; E05D 5/023; E05D 7/043; E05D 7/12; E05D 7/123; E05D 11/00; E05D 5/04; E05D 5/046; Y10T 16/5367; Y10T 16/5326; Y10T 16/554; Y10T 16/558; E05Y 2900/132; E05Y 2900/20
See application file for complete search history.

(56) References Cited

U.S. PATENT DOCUMENTS 546,909 A * 9/1895 Spencer ..... E05D 3/02 16/270
992,617 A * 5/1911 Varchmin et al. ..... E05D 7/04 16/240
1,360,284 A * 11/1920 Gagnon ..... E05D 7/04 16/249
1,469,525 A * 10/1923 Nadolney ..... E05D 7/12 16/271
1,481,142 A * 1/1924 Minton ..... E05F 1/1215 16/271
2,211,581 A * 8/1940 Ross ..... E05D 3/02 16/364
5,937,480 A * 8/1999 Kiefer ..... E05D 7/121 16/260
6,030,064 A * 2/2000 Kim ..... E05D 7/0423 312/405
6,112,460 A * 9/2000 Wagnitz ..... E06B 9/04 49/394
2014/0150345 A1* 6/2014 Price ..... E05D 7/0018 49/381

FOREIGN PATENT DOCUMENTS

CN 209585989 U * 11/2019
JP 2000192748 A * 7/2000

* cited by examiner

*Primary Examiner* — Chuck Y Mah
(74) *Attorney, Agent, or Firm* — Luis Figarella

(57) ABSTRACT

A hinge including two parts, the first part having a folding portion formed by a first leaf having holes and the second leaf having mechanical components for support, the second part formed by a portion having mounting holes and complementary mechanical support components to those in the first part.

2 Claims, 7 Drawing Sheets

DOOR HINGE

The following documents and references are incorporated by reference in their entirety, Davidian (U.S. Pat. No. 5,193,308), Price (U.S. Pat. Pub. No. 2014/0150345), Flaman et al (U.S. Pat. Pub. No. 2013/0007986), Root et al (U.S. Pat. No. RE45,355), Reichel (U.S. Pat. Pub. No. 2011/0099755) and Hodgson (U.S. Pat. No. 5,956,809).

FIELD OF THE INVENTION

The present invention relates to a hinge for vertically hanging a swinging entity, more particularly the present invention relates to a hinge structure to facilitate installation of a door to the door frame by a single individual.

DESCRIPTION OF THE RELATED ART

Hanging a door is usually a two-person job, where because the door hinge suffers from a number of well-known problems, they are difficult to install because vertical and angular positioning tolerances on the hinge plate are small. This forces the installation process to usually require two people, one to hold the door, the other to guide and align the connection of the two hinge parts. Hence it is common practice to make pre-hung door assemblies in a factory using jigs or the like wherein alignment is performed under controlled assembly conditions and for the user to purchase such factory made pre-hung doors assemblies. Obviously, such assemblies are comparatively expensive.

A number of different hinge structures have been suggested and patented that attempt to overcome some of these difficulties including accommodating differential warping or some relative displacement of the frame and door or closure member. What is needed, is an easy to engage hinge assembly that allows for the interconnection to be easily and quickly accomplished by a single individual.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a hinge structure comprising a first and a second part, wherein said first part is comprised of a first and a second leaf whose common ends have a connecting hinge component, said connecting hinge component defining a vertical axis, wherein said first leaf has one or more through openings, and said second leaf has one or more through openings and said second part is comprised of one or more pieces that have one or more through openings as well as a support tab located at the bottom of said second part, so that when said second leaf rests on said second part, there is one position wherein the openings in said second part align with those of said second leaf. In another aspect, said hinge components are comprised of at least one of the followings: knuckle, loop, joint, node, curl or flexible strip. In yet another aspect, said second leaf has one or more tabs extending from said upper and/or lower edge, said second part structure support tab has one or more openings along said tab's bottom, so that when said second one or more leaf tab is nestled within said second part opening, the openings in said second part align with those of said second leaf. In another aspect, said second part has one or more stops along one edge. In yet another aspect, said second part has one or more stops along one edge.

Other features and advantages of the present invention will become apparent upon examining the following detailed description of an embodiment thereof, taken in conjunction with the attached drawings.

Figure 1:
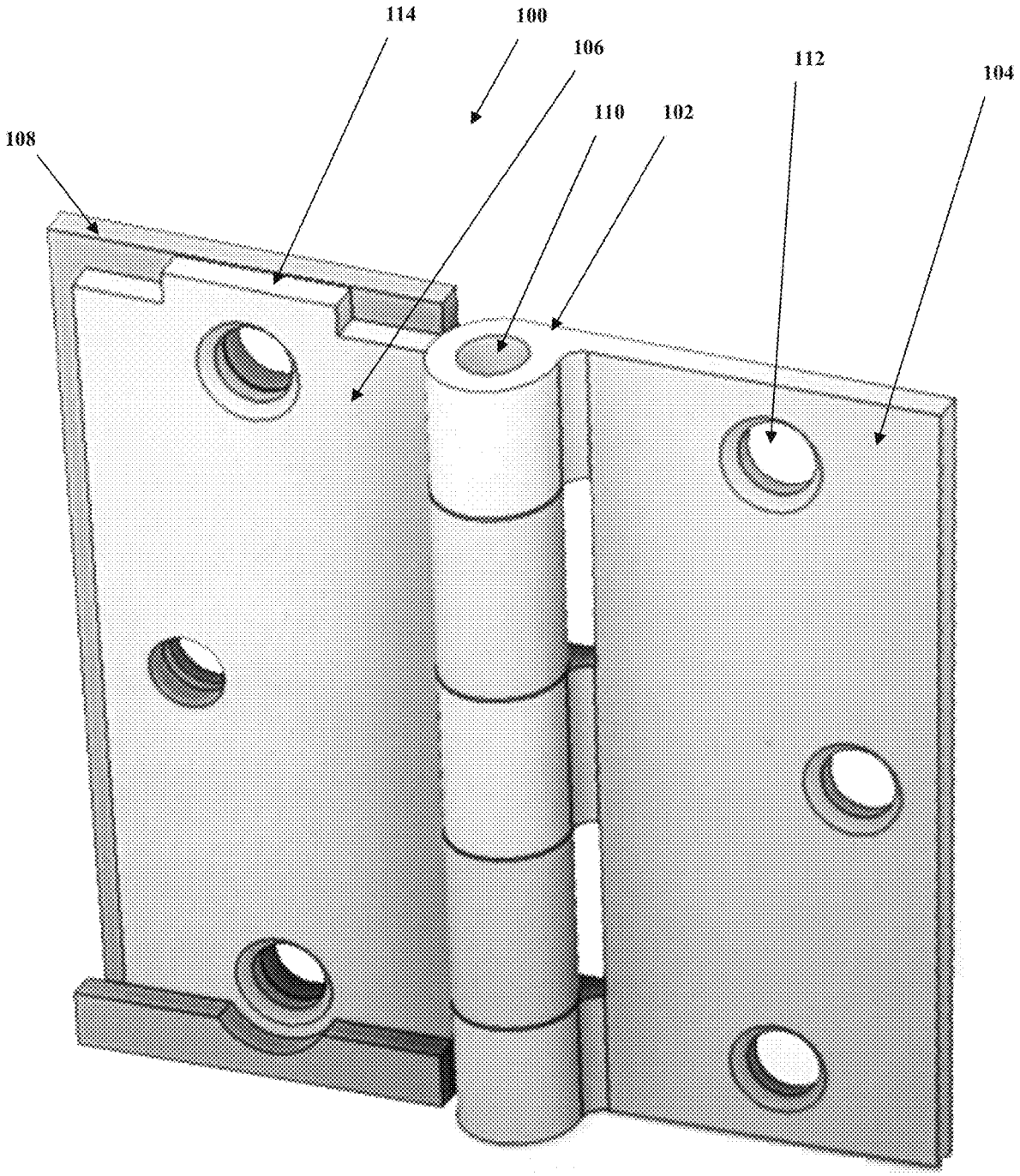
FIG. 1 shows an isometric view of the first part housed within the second part, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
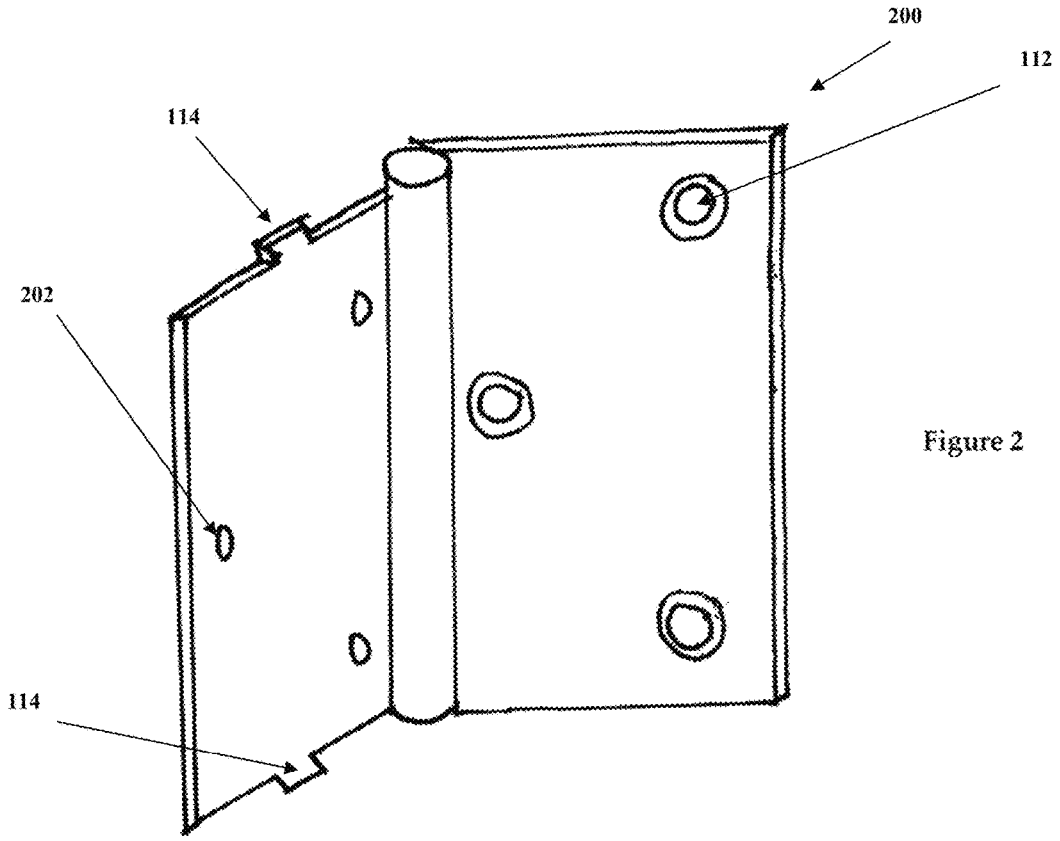
FIG. 2 shows an illustration of the front view of the first part of a proposed improved hinge, according to an exemplary embodiment of the invention.
Figure 3:
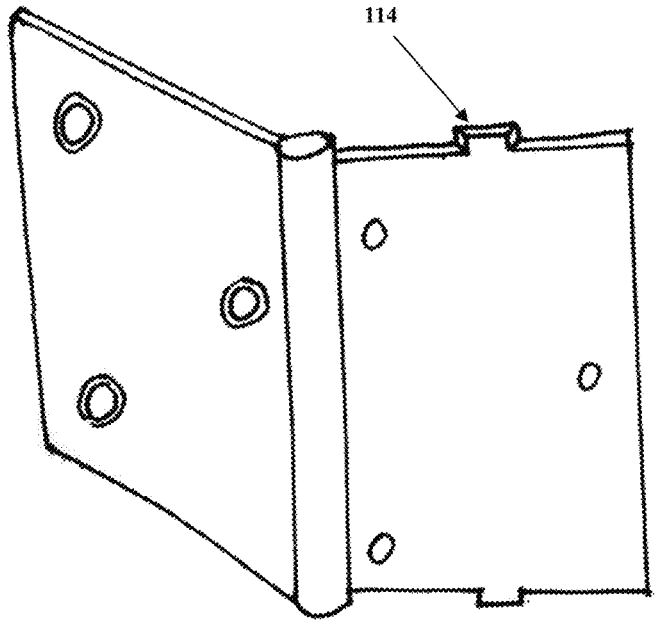
FIG. 3 shows an illustration of the back view of the first part of a proposed improved hinge, according to an exemplary embodiment of the invention.

Referring to FIGS. 1-3 we see an embodiment of the invention. The hinge structure 100 is split onto two parts, a first part 200 comprised of a first leaf 104 and a second leaf 106 whose joining forms the central hinging component or knuckle 102, and a second part 108 which forms a receiver for the first part when attaching a door to a door frame.

The hinging component 102 allows the first leaf 104 and the second leaf 106 of the first part to rotate around said hinge 102 in order to open and close. Said hinging component 102 may be comprised of the traditional knuckle connecting both leaves. The knuckle is the hollow circular part at the joint of a hinge through which a pin is passed. The knuckle is often called a loop, joint, node or curl. In another embodiment, the common end of both leaves form complementary parts of said knuckle. When one or more pins 110 go through the knuckle, both leaves 104/106 act as a hinge. In another embodiment, said hinging components 102 are comprised of flexible metal, plastic or composite strips capable of bending.

Figure 4:
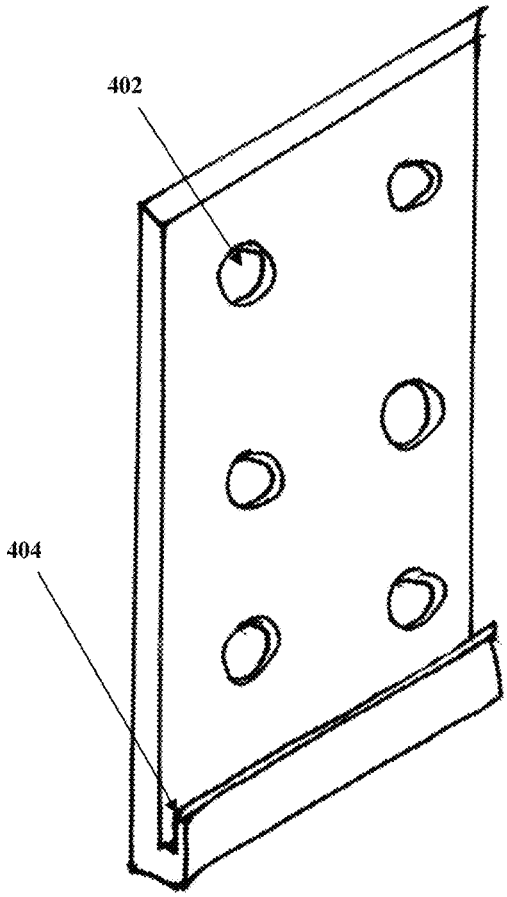
FIG. 4 shows an illustration of the front view of the second part of a proposed improved hinge, according to an exemplary embodiment of the invention.
Figure 5:
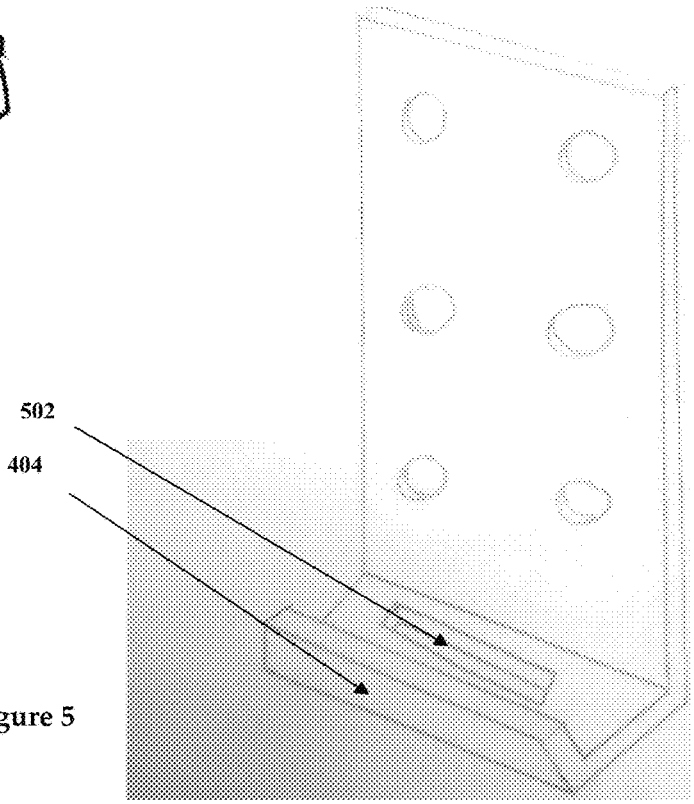
FIG. 5 shows an illustration of a side view of the second part, with a clear view of the notch, according to an exemplary embodiment of the invention.

Said first leaf 104 of said first part 200 of the hinge structure has one or more openings 112 so that said first leaf 104 may be attached to the door or the door jamb via screws or nails or similar attachment components. The second leaf 106 of said first part 200 has one or more similar openings 202 whose position is coordinated to that when properly inserted onto the second part 108, the holes/openings 202 of the second leaf 106 align with the holes/openings 402 (FIGS. 4-5) of the second part 108, so that the same screws or nails or similar attachment components may be used.

When placing the first part 200 onto the second part 108, said first part 200 is usually already mounted on the door, with said second part 108 already mounted on the door jamb (or vice-versa). In one embodiment, this is assisted by the addition of a mechanical component to act as a support tab 404 formed at the bottom of the second part. In this fashion, the support tab 404 supports the bottom of the second leaf 106 of said first part 200. Thus, the placing of the bottom of said second leaf 106 as it is slips into said support tab mechanical component allows for some weight support of both the first part 200 and whatever door or other device is attached to it.

These mechanical components forming the support tab 404 may be comprised of slots, hooks, awnings, edges, tabs, flaps or similar supports that are mechanically linked to said second part 108. While these support tab 404 may be angled in one embodiment, in another they are horizontal.

In one embodiment, the second part 108 has a tab 114 at one or both ends, which when paired (FIG. 5) with an opening 502 placed within said support tab 404, allows for the second leaf 106 to be 'centered' within said tab 404 in a way in which the openings 202/402 are centered 100 when correctly seated. Notice that in one embodiment, the tab 114 may be square or round or any other suitable shape that fits within the opening 502. This may include having one or more said tabs 114, as well as having tabs only on one end of said second leaf 106.

Figure 6:
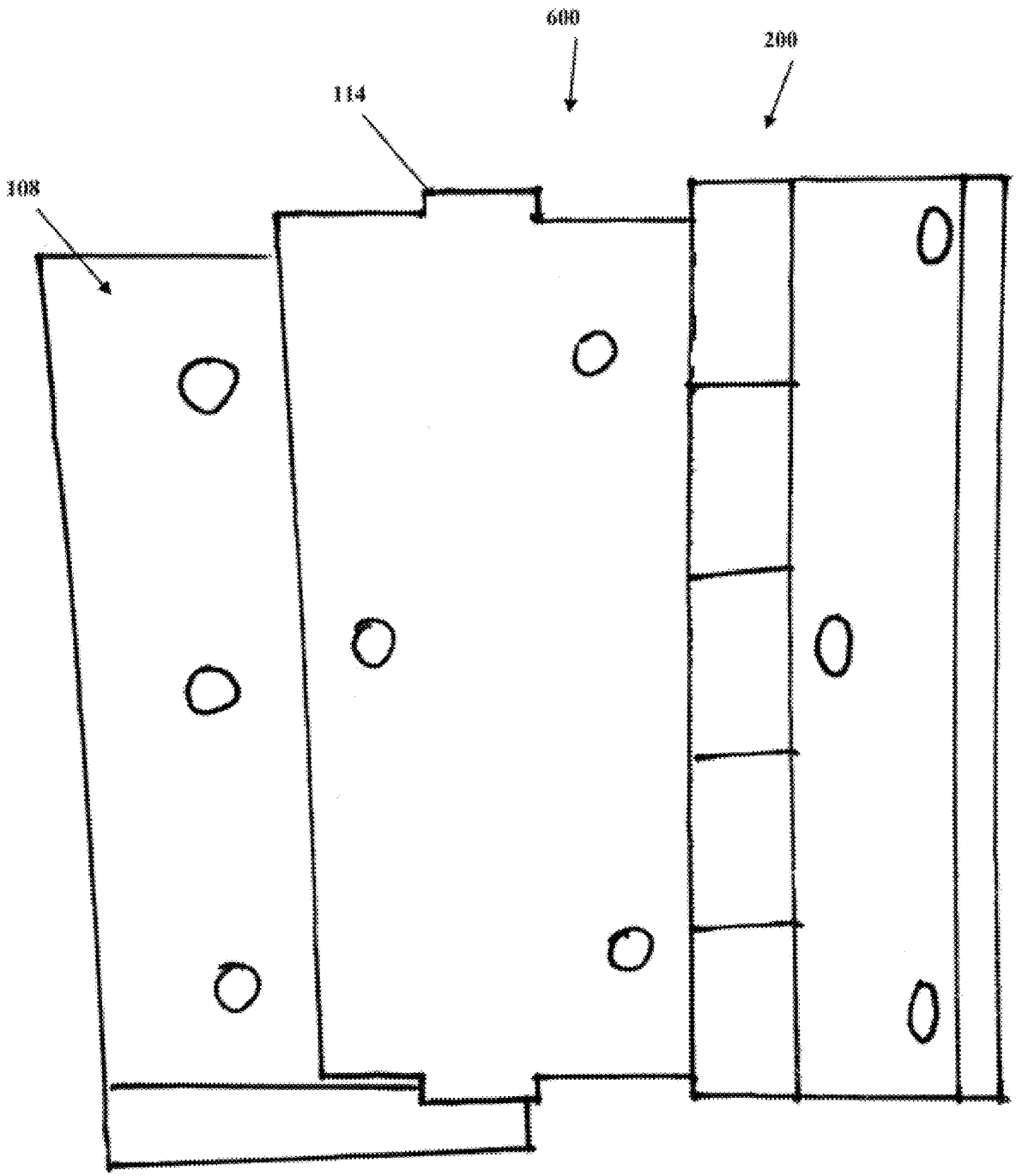
FIG. 6 shows a front view of the first part in front of the second part, according to an exemplary embodiment of the invention.
Figure 7:
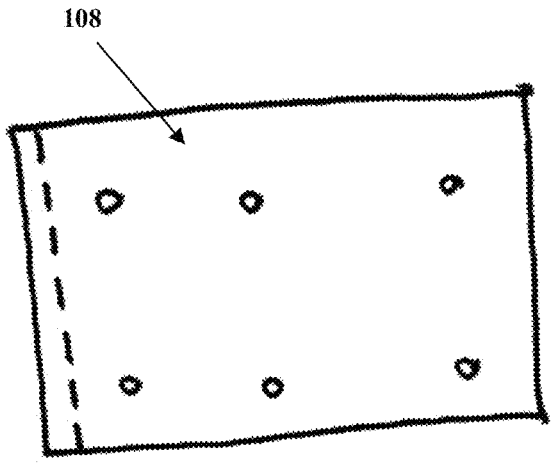
FIG. 7 shows a front view of the second part, according to an exemplary embodiment of the invention.
Figure 8:
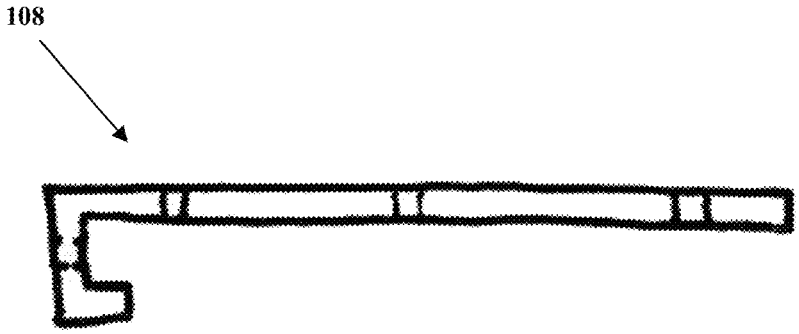
FIG. 8 shows a side view illustration of the second part, according to an exemplary embodiment of the invention.
Figure 9:
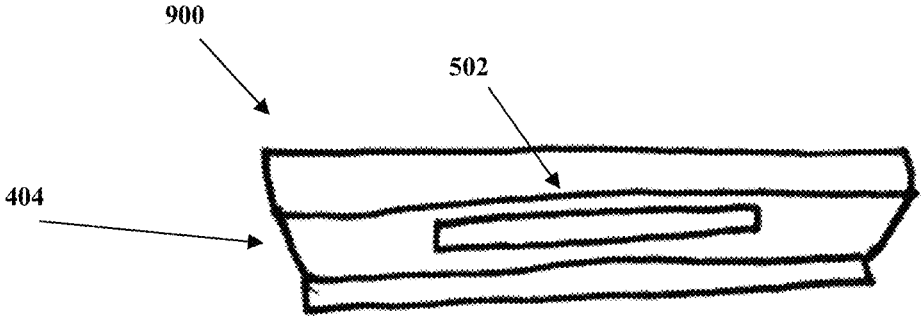
FIG. 9 shows a top view illustration of the second part, according to an exemplary embodiment of the invention.
Figure 10:
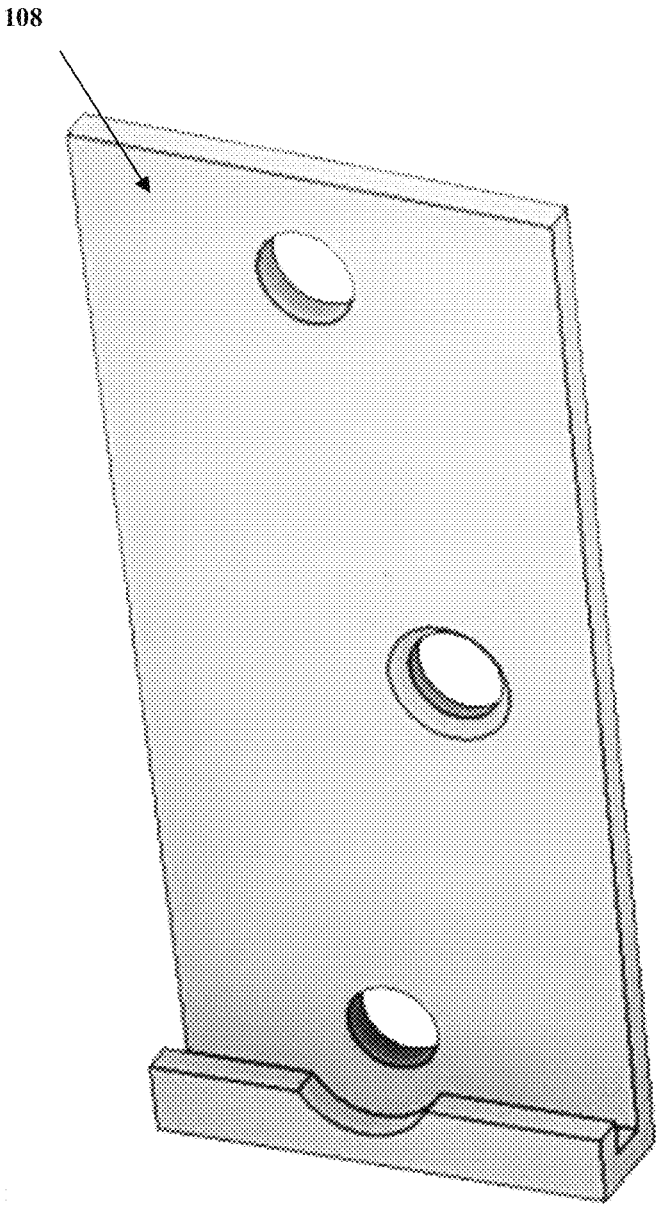
FIG. 10 shows an isometric view of the second part, according to an exemplary embodiment of the invention.
Figure 11:
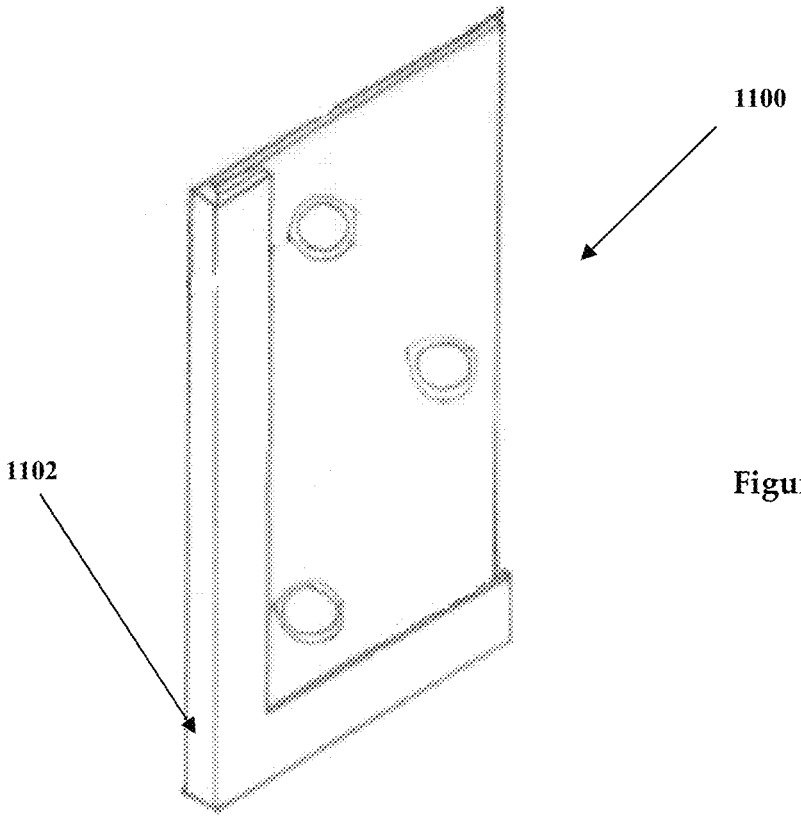
FIG. 11 shows an isometric view of the second part, according to an exemplary embodiment of the invention.

In another embodiment, the end of the second part 108 may have one or more stops 1102 (such as a solid end, or a solid lip, or a solid lip going all the way up), so that the components 202/402 match openings as the second part 108 rests against the stop 1102 (FIG. 11), with or without the tab 114 going into the opening 502. In FIG. 6, we can see the first part 200 in front of the second 108. In FIGS. 7-10 we see other views of the parts.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A hinge structure comprising:

a first and a second part;

wherein said first part is comprised of a first and a second leaf whose common ends have a connecting hinge component, said connecting hinge component defining a vertical axis, wherein said first leaf has one or more through openings, and said second leaf has one or more through openings;

said second part is comprised of one or more pieces that have one or more through openings as well as a support tab located at the bottom of said second part, so that when said second leaf rests on said second part, there is one position wherein the openings in said second part align with those of said second leaf;

said connecting hinge component is comprised of at least one of the following:

knuckle, loop, joint, node, curl or flexible strip;

wherein said second leaf has one or more tabs extending from the upper and/or lower edge; and said second part structure support tab has one or more openings along said tab's bottom, so that when said second one or more leaf tab is nestled within said second part opening, the openings in said second part align with those of said second leaf.

2. The structure of claim 1 wherein;

said second part has one or more stops along one edge.

* * * * *